US011549306B2

(12) United States Patent
Koennecke

(10) Patent No.: US 11,549,306 B2
(45) Date of Patent: Jan. 10, 2023

(54) ENTRYWAY SEAL SUITABLE FOR ATTACHMENT TO BREAKOUT SIDE PANEL OF SLIDING DOOR

(71) Applicant: GLOBAL MATERIAL TECHNOLOGIES, INCORPORATED, Buffalo Grove, IL (US)

(72) Inventor: Weston Koennecke, Oak Park, IL (US)

(73) Assignee: GLOBAL MATERIAL TECHNOLOGIES, INCORPORATED, Buffalo Grove, IL (US)

( * ) Notice: Subject to any disclaimer, the term of this patent is extended or adjusted under 35 U.S.C. 154(b) by 64 days.

(21) Appl. No.: 17/189,672

(22) Filed: Mar. 2, 2021

(65) Prior Publication Data

US 2022/0282563 A1 Sep. 8, 2022

(51) Int. Cl.
*E06B 7/23* (2006.01)

(52) U.S. Cl.
CPC ..... *E06B 7/2316* (2013.01); *E06B 7/2312* (2013.01)

(58) Field of Classification Search
CPC ..... E06B 7/2316; E06B 7/2312; E06B 3/5072
USPC ..... 49/310
See application file for complete search history.

(56) References Cited

U.S. PATENT DOCUMENTS 1,560,097 A * 11/1925 Petersen ..... E06B 7/2316 49/470
1,771,599 A * 7/1930 Wilson ..... E06B 7/20 49/309
3,811,489 A * 5/1974 Thun ..... E06B 3/481 16/307
4,015,368 A * 4/1977 Court ..... E06B 7/2312 49/495.1
4,380,260 A * 4/1983 Labelle ..... E06B 7/2316 160/183
4,428,153 A * 1/1984 Klinger ..... E05C 19/002 49/366
4,527,807 A * 7/1985 Urbanick ..... B60J 10/86 277/921

(Continued)

FOREIGN PATENT DOCUMENTS

DE 202013002159 U1 * 5/2013 ..... E06B 7/18
DE 102015218716 A1 * 3/2017 ..... E06B 7/18

(Continued)

*Primary Examiner* — Marcus Menezes
(74) *Attorney, Agent, or Firm* — Patzik, Frank & Samotny Ltd.

(57) ABSTRACT

An entryway seal is suitable for attachment to the breakout panel of a sliding door, substantially sealing a gap disposed between the breakout panel and the adjacent floor. The entryway seal includes a first retaining member having a bottom surface, a second retaining member having a bottom surface, a first sealing member operably coupled to the first retaining member, at least a portion of the first sealing member being disposed proximate the bottom surface of the first retaining member, a second sealing member operably coupled to the second retaining member, at least a portion of the second sealing member being disposed proximate the bottom surface of the second retaining member, and a connecting member flexibly connecting the first retaining member to the second retaining member.

17 Claims, 6 Drawing Sheets

(56) References Cited

U.S. PATENT DOCUMENTS

| | | | | |
|---|---|---|---|---|
| 4,691,478 | A * | 9/1987 | Lorg | E06B 7/2316 49/499.1 |
| 5,454,192 | A * | 10/1995 | Adler | E06B 7/20 49/307 |
| 6,195,939 | B1 * | 3/2001 | Sowers | E06B 7/21 49/307 |
| 6,526,695 | B1 | 3/2003 | Nguyen | |
| 6,910,301 | B2 * | 6/2005 | Kalempa | E06B 7/16 49/367 |
| 9,867,367 | B2 * | 1/2018 | Schild, III | A01M 29/30 |
| 10,280,678 | B1 * | 5/2019 | Rendon, Jr | E06B 3/509 |
| 10,494,858 | B2 | 12/2019 | Shanahan et al. | |
| 10,661,881 | B2 * | 5/2020 | Gallagher, Jr | E05C 19/001 |
| 2002/0100219 | A1 * | 8/2002 | Rissone | E06B 7/2316 49/470 |
| 2014/0360101 | A1 * | 12/2014 | Whiting, Jr. | B60J 10/86 49/490.1 |
| 2015/0075080 | A1 * | 3/2015 | Ellingson | H02B 1/28 49/489.1 |
| 2016/0208529 | A1 * | 7/2016 | Gillen | E06B 1/70 |
| 2017/0218683 | A1 | 8/2017 | Shanahan et al. | |
| 2018/0320437 | A1 | 11/2018 | Dintheer | |
| 2020/0157877 | A1 * | 5/2020 | McKinnon | E06B 7/2316 |
| 2022/0025674 | A1 * | 1/2022 | Rios | E05B 7/00 |
| 2022/0042371 | A1 * | 2/2022 | Borovitz-Linda | E06B 7/18 |

FOREIGN PATENT DOCUMENTS

| | | | | |
|---|---|---|---|---|
| GB | 2362178 A | * | 11/2001 | B60J 10/80 |
| GB | 2464090 A | * | 4/2010 | E06B 7/2312 |
| NL | 1008520 C2 | * | 9/1999 | E06B 7/2316 |

* cited by examiner

ENTRYWAY SEAL SUITABLE FOR ATTACHMENT TO BREAKOUT SIDE PANEL OF SLIDING DOOR

BACKGROUND OF THE INVENTION

1. Field of the Invention

The present application relates, in general to entryway seals, and more particularly to an entryway seal that is suitable to attachment to a breakout side panel of an automatic sliding door system.

2. General Background of the Invention

Commercial sliding doors, in particular automatic sliding door systems, are in relatively common use for pedestrian entry and egress from larger structures, such as, for example, larger "big box" stores. A common design of these sliding door systems includes two opposing, automatically actuated sliding doors, with additional, stationary door panels on opposing sides of the entryway. Primarily for safety reasons, these stationary door panels are often in the form of breakout, or breakaway panels, which, while normally stationary, rotate or pivot outwardly upon the application of sufficient manual force, in order to provide a path of egress from the associated structure in the event of an emergency, when electrical power to the sliding doors is lost, the sliding doors are otherwise inoperative, or for cleaning or maintenance operations. Examples of such sliding door systems having breakout panels may be found, for example, in U.S. Pat. No. 6,526,695 and international publication No. WO 01/07742 A1, the entirety of both of which are hereby incorporated by reference.

As with most entryways, it is desirable to seal the gaps around the doors and panels of automatic sliding door systems, to provide an enhanced thermal barrier, as well as a barrier against the passage of insects, rodents and other vermin into the associated building or structure. With breakout side panels of sliding door systems, it is desirable to have a bottom seal that extends horizontally, not only across the width of the breakout side panel itself, but also across the vertical gap that commonly exists between the breakout side panel and the adjacent vertical surface, such as a stationary door casing, door frame, and/or door region. When a conventional door sweep is attached to a breakout side panel so as to extend across this vertical gap, however, damage or separation of the door sweep can occur when the breakout panel is pivoted outward, as the outward swinging of the breakout panel results in undesirable, forceful contact between the door sweep and the stationary door casing, door frame, and/or door region. Moreover, attaching a conventional door sweep to a breakout panel may inhibit the ability of the breakout panel to function properly in an emergency, inhibiting egress from the associated building or structure.

Accordingly, it is an object of the present invention to provide an entryway seal that is suitable to attachment to a breakout side panel of a sliding door.

It is another object of the present invention to provide an entryway seal that, upon attachment to a breakout side panel of a sliding door in a position extending across a vertical gap between the breakout panel and adjacent stationary door casing, door frame, and/or door region, does not result in damage or separation of the entryway seal when the breakout side panel is swung open.

These and other objects and features of the present invention will become apparent in view of the following specification, drawings, and claims.

BRIEF SUMMARY OF THE INVENTION

The present invention comprises a sealing apparatus, such as a door sweep, for substantially sealing a gap disposed between a movable closure, such as a breakout panel of a sliding door system, and an adjacent surface, such as a floor. The sealing apparatus comprises a first retaining member, such as a fixed retainer, having a bottom surface, a second retaining member, such as a floating retainer or a free retainer, having a bottom surface.

A first sealing member, such as a resilient bottom seal, is operably coupled to the first retaining member, with at least a portion of the first sealing member being disposed proximate the bottom surface of the first retaining member. A second sealing member, such as another resilient bottom seal, is operably coupled to the second retaining member, with at least a portion of the second sealing member being disposed proximate the bottom surface of the second retaining member.

A connecting member, which may comprise a biasing member or hinge member, such as, for example, a hinge having a slotted pin or coil spring, flexibly connects the first retaining member to the second retaining member. In a preferred embodiment, the connecting member biases the first sealing member and the second sealing member towards colinear alignment with each other.

The present invention also comprises a combination of an entryway of a structure, such as an automatic sliding door system of a building, and a sealing apparatus, such as a door sweep. The entryway includes a moveable closure, such as a breakout panel of the sliding door system, a horizontal surface, such as the floor, adjacent the moveable closure, a first gap disposed between the moveable closure and the horizontal surface, and a stationary vertical surface, such as a door casing or door frame, adjacent the moveable closure. A second gap is disposed between the moveable closure and the vertical surface.

The first retaining member and the second retaining members both have bottom surfaces. A first sealing member is operably coupled to the first retaining member and extends across at least a portion of the first gap, with at least a portion of the first sealing member being disposed proximate the bottom surface of the first retaining member. A second sealing member is operably coupled to the second retaining member, with at least a portion of the second sealing member being disposed proximate the bottom surface of the second retaining member. The second sealing member is floating or free, in that the second sealing member is not directly attached to either the moveable closure or the stationary vertical surface. A connecting member flexibly connects the first retaining member to the second retaining member.

The first retaining member is operably coupled to the moveable closure, and is positioned such that first sealing member overlies at least a portion of the first gap. At the same time, the second retaining member overlies both at least a portion of the moveable closure and at least a portion of the stationary vertical surface. The connecting member biases the second retaining member towards the stationary vertical surface.

The present invention also comprises a method of sealing an entryway, such as an automatic sliding door system, having a moveable closure, such as a breakout panel, a horizontal surface, such as a floor, adjacent the moveable closure, a first gap disposed between the moveable closure and the horizontal surface, a stationary vertical surface, such as a door casing or door frame, adjacent the moveable closure, and a second gap disposed between the moveable closure and the vertical surface.

A sealing apparatus is provided, wherein the sealing apparatus comprises a first retaining member, comprising a retainer or mounting bracket, having a bottom surface, a second retaining member, such as a floating retainer or a free retainer, having a bottom surface, a first sealing member, such as a resilient bottom seal, is operably coupled to the first retaining member with at least a portion of the first sealing member being disposed proximate the bottom surface of the first retaining member, a second sealing member, such as another resilient bottom seal, is operably coupled to the second retaining member with at least a portion of the second sealing member being disposed proximate the bottom surface of the second retaining member, and a connecting member, such as a hinge having a slotted pin or coil spring, flexibly connects the first retaining member to the second retaining member; and The first retaining member is affixed to at least a portion of the moveable closure using fasteners, a strong adhesive, or industrial high strength pressure sensitive tape, and is positioned such that the first sealing member overlies at least a portion of the first gap, and the second retaining member overlies both at least a portion of the moveable closure and at least a portion of the stationary vertical surface. In a preferred embodiment, the connecting member biases the second retaining member towards the stationary vertical surface.

DETAILED DESCRIPTION OF THE INVENTION

Figure 1:
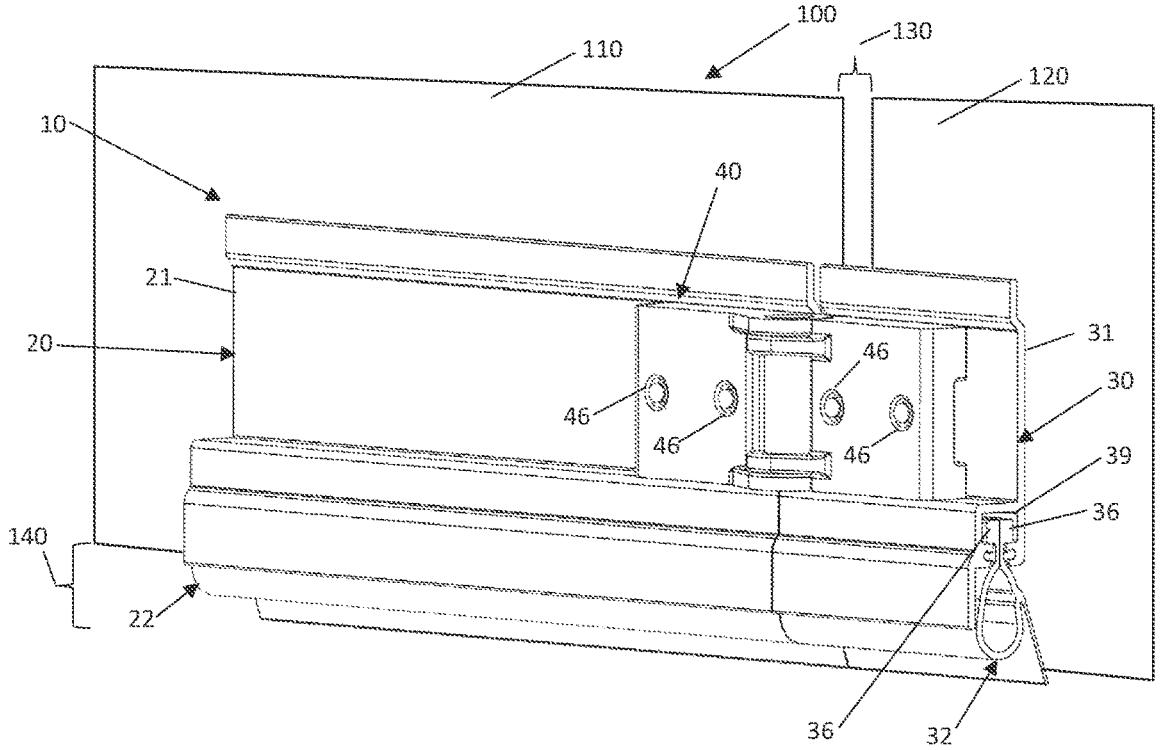
FIG. 1 is a front perspective view of the present entryway seal, shown attached to a breakout side panel of a sliding door and positioned partially across a vertical gap and a stationary vertical surface.

While the present invention is susceptible of embodiment in many different forms, there is shown in the drawings and will herein be described in detail, multiple embodiments, with the understanding that the present disclosure is intended as an exemplification of the principles of the present invention and is not intended to limit the invention to the embodiments illustrated.

The present door sweep or entryway seal 10, shown attached to a breakout panel 110 of a sliding door system 100, is shown in FIG. 1 as comprising fixed seal 20, floating or free seal 30, and hinge member 40, flexibly coupling fixed seal 20 and free seal 30 together. Fasteners, such as rivets 46, couple opposing leaves, or wings, of hinge member 40 to fixed seal 20 and free seal 30. Fixed seal 20 comprises fixed retainer 21 and fixed bottom seal 22. Free seal 30 comprises floating or free retainer 31 and floating or free bottom seal 32.

As shown in FIG. 1, breakout panel 110 is spaced laterally from stationary door casing, door frame, and/or door trim 120 by vertical gap 130. This spacing, in conjunction with an internal pivoting mechanism (not shown) of the automatic sliding door system, enables breakout panel 110 to outwardly, in the direction of the viewer of FIG. 1, for egress from the associated structure in the event of emergencies, and for routine cleaning and maintenance of the sliding door system.

As further shown in FIG. 1, fixed seal 20 is fixedly attached to breakout panel 110 of sliding door system 100 using fasteners, a suitable strong adhesive, or industrial high strength pressure sensitive tape (not shown), and is positioned such that free seal 30 partially overlies breakout panel 110, straddles vertical gap 130 and further overlies stationary door casing, door frame, and/or door region 120. Free seal 30 is not, however, directly affixed to either breakout panel 110 or stationary door casing, door frame, and/or door region 120. Rather, free seal 30 is only coupled to fixed seal 20, via hinge member 40.

Moreover, and as shown in FIG. 1, entryway seal 10 is affixed to breakout panel 110 such that fixed bottom seal 22 and free bottom seal 32 both extend across bottom gap 140 between sliding door system 100 and the adjoining floor. In this manner, the bottom seals form an energy saving thermal barrier beneath door system 100, and can serve to inhibit the passage of insects, rodents, and other vermin through bottom gap 140.

Figure 3:
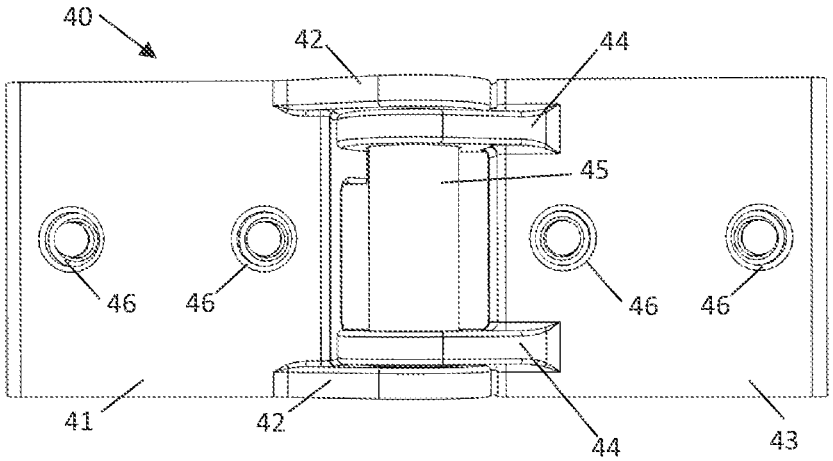
FIG. 3 is a front view of a first embodiment of the hinge member of the entryway seal of FIG. 1.
Figure 4:
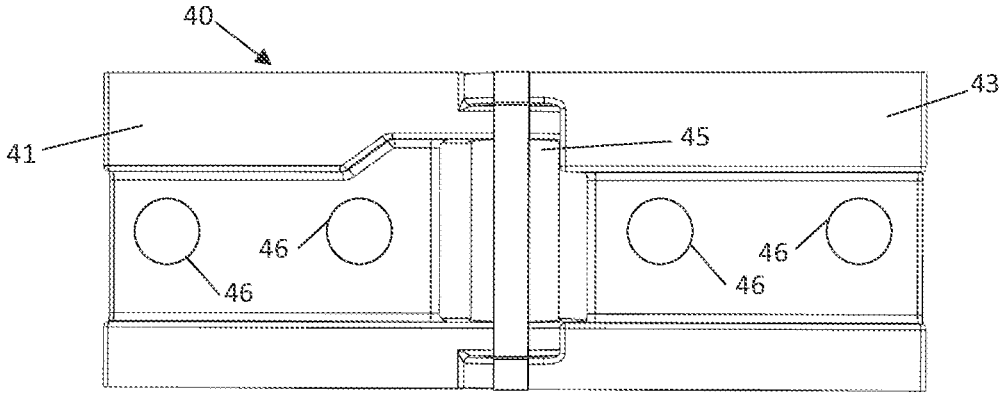
FIG. 4 is s rear view of the hinge member of FIG. 3.
Figure 5:
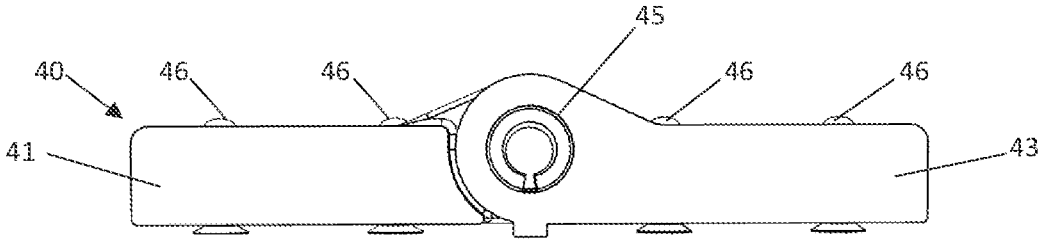
FIG. 5 is a bottom view of the hinge member of FIG. 3.

As shown in FIGS. 3-5, hinge member 40, in a first embodiment, comprises fixed wing or fixed leaf 41, fixed knuckles 42, free wing or free leaf 43, free knuckles 44, and slotted pin 45 extending through the interior of fixed knuckles 42 and free knuckles 44. Fixed leaf 41 and free leaf 43 each include apertures accommodating fasteners, such as rivets 46, enabling fixed leaf 41 to be securely affixed to fixed retainer 21, and free leaf 43 to be securely affixed to free retainer 31. Slotted pin 45 serves to rotationally bias fixed knuckles 42 and free knuckles 44 such that, upon attachment of entryway seal 10 to sliding door system 100, bottom free seal 30 is biased to remain in general contact with stationary door casing, door frame, and/or door region 120, regardless of whether breakout panel 110 is in its primary position generally coplanar to stationary door casing, door frame, and/or door region 120, or breakout panel 110 is swung open for emergency egress from the associated structure, or for purposes of routine cleaning or maintenance of sliding door system 100. At the same time, each of (i) fixed leaf 41 and floating leaf 43; (ii) fixed seal 20 and free seal 30; (iii) fixed retainer 21 and free retainer 31; and (iv) fixed bottom seal 22 and free seal 32; are each biased to be substantially coplanar to each other.

Figure 13:
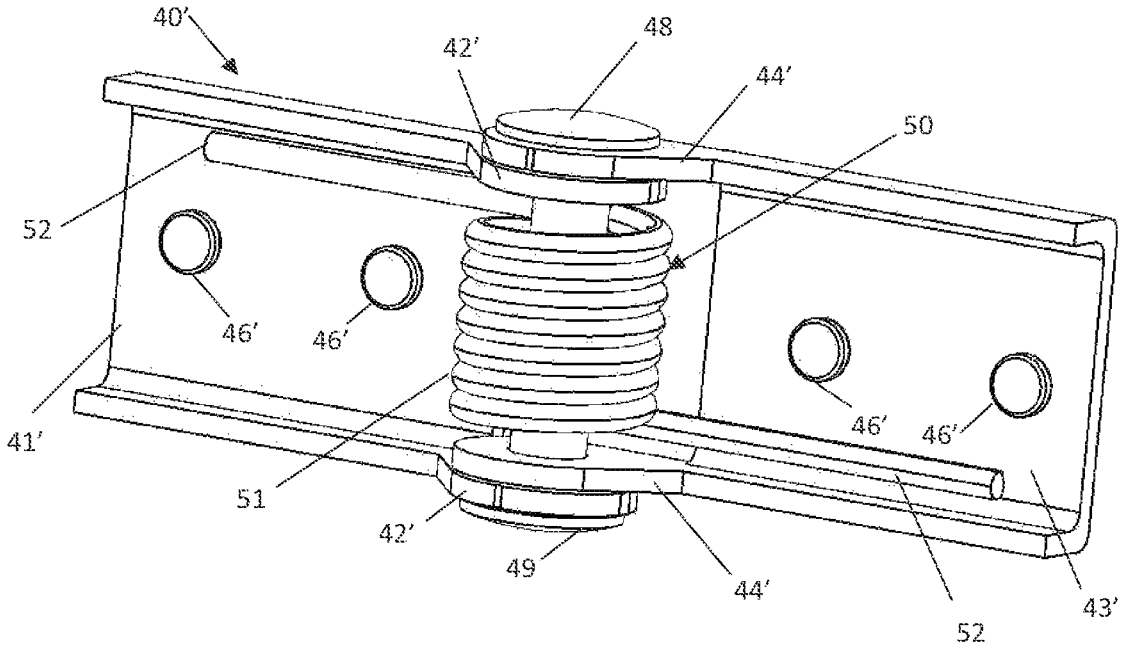
FIG. 13 is a front perspective view of a second embodiment of the hinge member.

Another embodiment of hinge member 40' is shown in FIG. 13 as comprising fixed wing or fixed leaf 41', fixed knuckles 42', free wing or free leaf 43', free knuckles 44', and binding post 48 extending through the interior of fixed knuckles 42' and free knuckles 44', as well as the interior of windings 51 of coil spring 50. End cap 49 is affixed to the open end of the barrel of binding post 48 to retain binding post 49 in this position. Notably, in this embodiment, fixed leaf 41' and free leaf 43' are identical in configuration, and may be of stamped metal construction. Fixed leaf 41' and free leaf 43' each include apertures accommodating fasteners, such as solid rivets 46', enabling fixed leaf 41' to be securely affixed to fixed retainer 21, and free leaf 43' to be securely affixed to free retainer 31. Arms 52 of coil spring 50 serve to rotationally bias fixed leaf 41' and free leaf 43' in a manner similar to the rotational bias imparted upon by slotted pin 45 upon fixed knuckles 42 and free knuckles 44 in the embodiment of hinge member 40. Yet another form of resilient component may be used in place of slotted pin 45 or coil spring 50.

Figure 2:
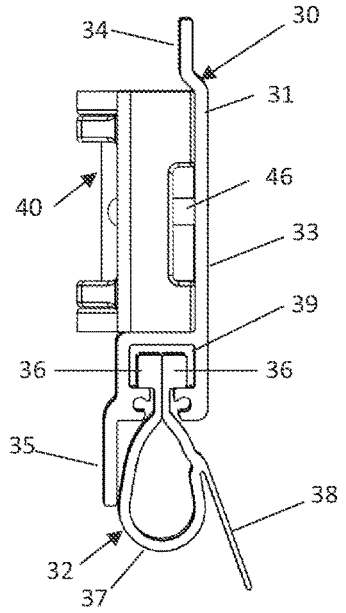
FIG. 2 is a right side view of the entryway seal of FIG. 1.
Figure 6:
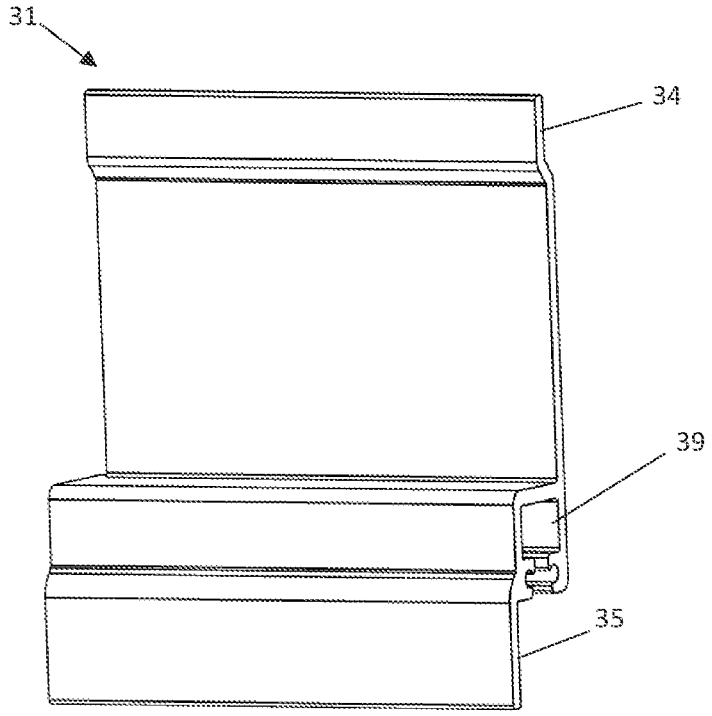
FIG. 6 is a front perspective view of the free retainer of the entryway seal of FIG. 1.
Figure 7:
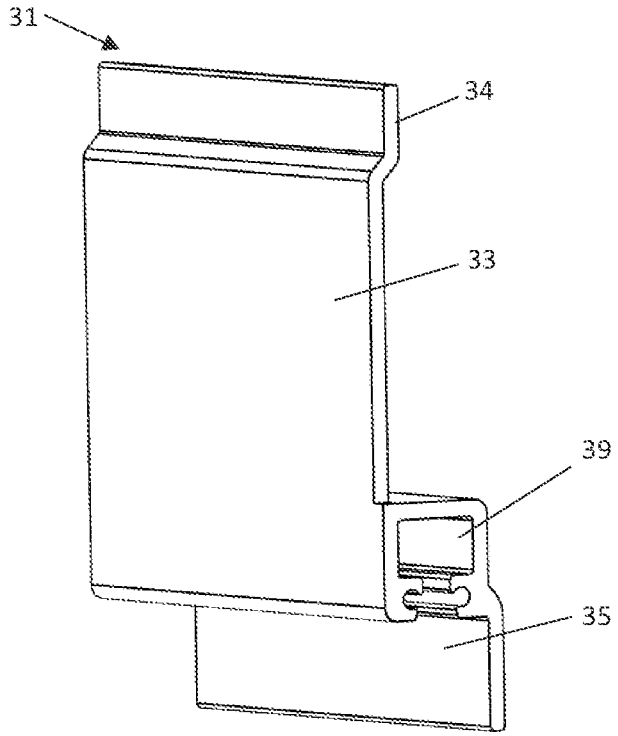
FIG. 7 is a rear perspective view of the free retainer of FIG. 6.

Free retainer 31 is shown in FIGS. 2 and 6-7 as comprising door casing adjoining surface 33, top lip 34, bottom overhang 35, and longitudinal channel 39. Case adjoining surface 33 may include pre-drilled apertures (not shown) to accommodate fasteners, such as rivets 46, for affixing free leaf 43 of hinge member 40 to free retainer 31. As shown in FIG. 2, longitudinal channel 39 permits free bottom seal 32 to be releasably attached to free retainer 31, by advancing protrusions 36 of free bottom seal 32 through longitudinal channel 39. As further shown in FIG. 2, the vertical spacing between top lip 34 and the surface atop longitudinal channel 39 of free retainer 31 is sized to closely accommodate the vertical height of hinge member 40, serving to further retain hinge member 40 in its affixed position relative to free retainer 31.

Figure 8:
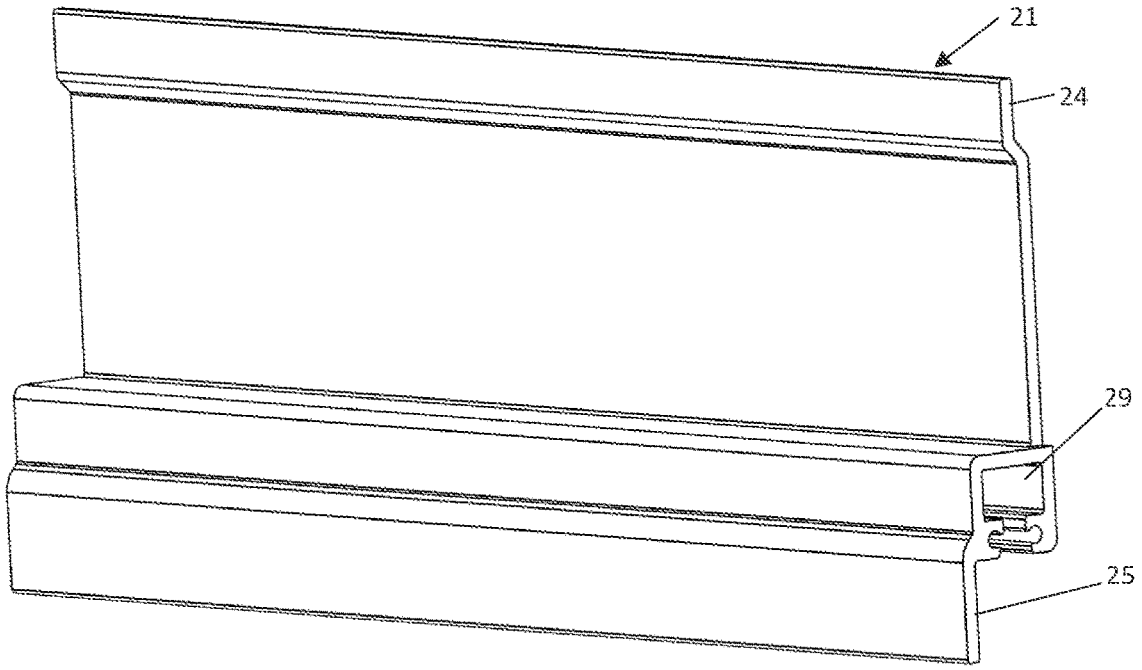
FIG. 8 is a front perspective view of the fixed retainer of the entryway seal of FIG. 2.
Figure 9:
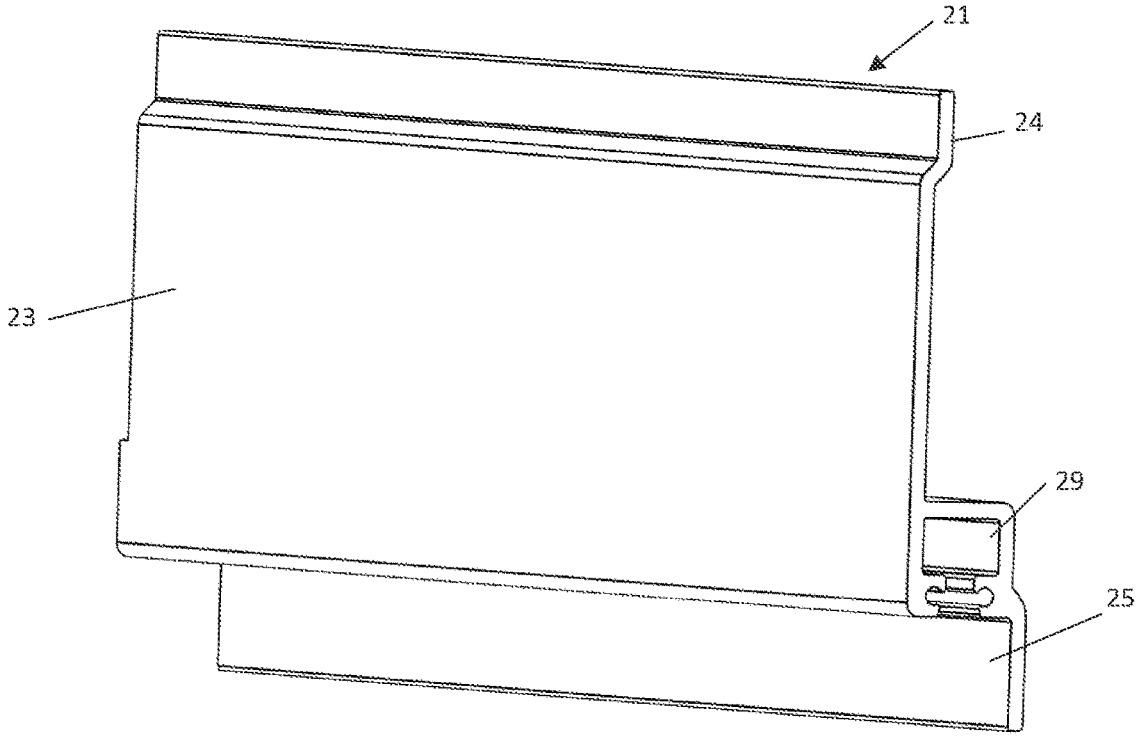
FIG. 9 is a rear perspective view of the fixed retainer of FIG. 8.

Fixed retainer 21 is shown in FIGS. 1 and 8-9 as comprising mounting surface 23, top lip 24, bottom overhang 25, and longitudinal channel 29. Mounting surface 23 may include pre-drilled apertures (not shown) to accommodate fasteners, such as rivets 46, for affixing fixed leaf 41 of hinge member 40 to fixed retainer 21. Longitudinal channel 29 permits fixed bottom seal 22 to be releasably attached to fixed retainer 21, by advancing protrusions 26 of fixed bottom seal 22 through longitudinal channel 29. As further shown in FIG. 1, the vertical spacing between top lip 24 and the surface atop longitudinal channel 29 of fixed retainer 21 is sized to closely accommodate the vertical height of hinge member 40, serving to further retain hinge member 40 in its affixed position relative to fixed retainer 21.

Figure 10:
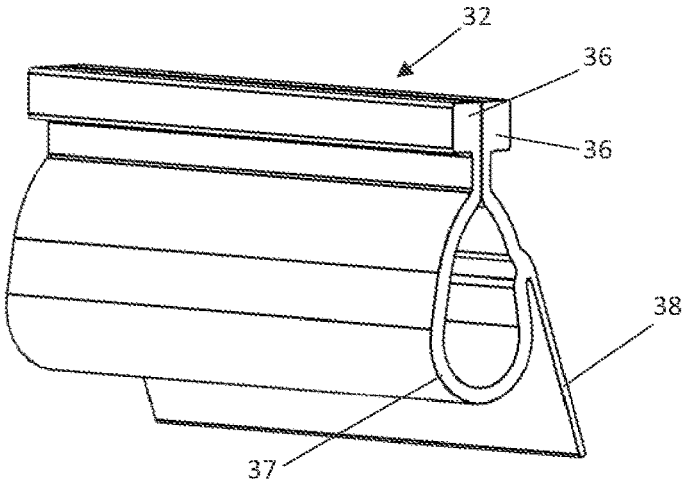
FIG. 10 is a front perspective view of the free bottom seal of the entryway seal of FIG. 1.

Free bottom seal 32 is shown in FIGS. 1-2 and 10 as comprising protrusions 36, generally teardrop-shaped region 37, and wiper 38. Free bottom seal 32 may be constructed from rubber or another resilient material, which may be folded or rolled in order to bring protrusions 36 into engagement with each other for advancement through longitudinal channel 39 of free retainer 31, while simultaneously forming the shape of generally teardrop-shaped region 37.

Figure 11:
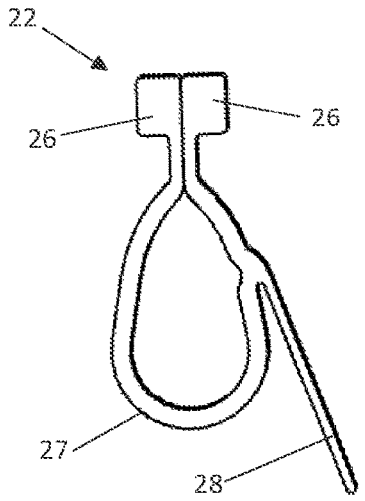
FIG. 11 is a right side view of the fixed bottom seal of the entryway seal of FIG. 1.
Figure 12:
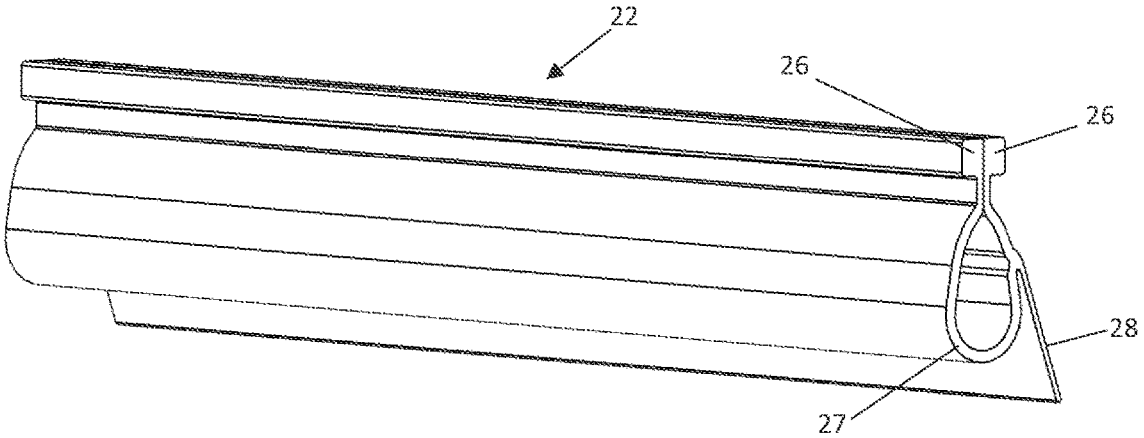
FIG. 12 is a front perspective view of the fixed bottom seal of FIG. 11.

Fixed bottom seal 22 is shown in FIGS. 11-12 as comprising protrusions 26, generally teardrop-shaped region 27, and wiper 28. Free bottom seal may be constructed from rubber or another resilient material, which may be folded or rolled in order to bring protrusions 26 into engagement with each other for advancement through longitudinal channel 29 of fixed retainer 21, while simultaneously forming the shape of generally teardrop-shaped region 26.

As an additional barrier against the intrusion of rodents and other vermin, the interior of teardrop-shaped regions 27 and 37 may contain a further inner material, preferably in the form of a metal fabric comprised of metal wire or fibers, woven or non-woven, or a composite metal/nonmetal fabric comprised of metal and nonmetal wire or fibers, woven or non-woven. Such materials are described in U.S. Pat. Nos. 5,972,814, 6,249,941, 6,298,538, 6,502,289, 6,583,074, and 6,919,117, the entirety of which are all hereby incorporated by reference. Alternatively, free bottom seal 32 and fixed bottom seal 22 may have a vermin barrier construction similar to the cushion-style seal disclosed in U.S. Pat. No. 9,867,367, the entirety of which is hereby incorporated by reference.

In operation, once entryway seal 10 has been affixed to breakout panel 110 in the manner described above, fixed bottom seal 22 and free bottom seal 32 substantially occupy the space of bottom gap 140, providing a weather and vermin-resistant barrier. With breakout panel 110 in this position, slotted pin 45 of hinge member 40 serves to bias free seal 30 so as to maintain free bottom seal 32 in substantial linear alignment with fixed bottom seal 22, and to maintain free retainer 31 in contact with stationary door casing, door frame, and/or door region 120, spanning vertical gap 130.

In the event that breakout panel 110 is pivoted outwardly relative to stationary door casing, door frame, and/or door region 120, such as in the event of an emergency or for routine maintenance or cleaning of sliding door system 100, fixed bottom seal 22 will pivot outwardly with breakout panel 110. At the same time, hinge member 40 will pivot about slotted pin 45, with slotted pin 45 continuing to bias free seal 30 and free bottom seal 32 towards stationary door casing, door frame, and/or door region 120. In this manner, bottom gap 140 will continue to be substantially covered by fixed bottom seal 22 and free bottom seal 32, without damage to entryway seal 10.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of construction of the invention disclosed herein without departing from the spirit and scope of the invention. The present disclosure is intended to exemplify and not limit the invention.

What is claimed is:

1. A sealing apparatus attachable to a movable closure for substantially sealing a gap disposed between the movable closure and an adjacent surface, the sealing apparatus comprising:

a first retaining member having a bottom surface and a mounting surface for mounting the first retaining member to the movable closure;

a second retaining member having a bottom surface;

a first sealing member operably coupled to the first retaining member, at least a portion of the first sealing member being disposed proximate the bottom surface of the first retaining member;

a second sealing member operably coupled to the second retaining member, at least a portion of the second sealing member being disposed proximate the bottom surface of the second retaining member; and a connecting member pivotably connecting the first retaining member to the second retaining member, wherein the connecting member does not fixedly connect the movable closure to the adjacent surface.

2. The sealing apparatus according to claim 1, wherein the connecting member comprises a hinge.

3. The sealing apparatus according to claim 2, wherein the hinge includes a biasing member.

4. The sealing apparatus according to claim 3, wherein the biasing member comprises a slotted pin.

5. The sealing apparatus according to claim 3, wherein the biasing member comprises a coiled spring.

6. The sealing apparatus according to claim 1, wherein the connecting member biases the first sealing member and the second sealing member towards colinear alignment with each other.

7. A combination of an entryway of a structure and a sealing apparatus, comprising:

a moveable closure;

a horizontal surface adjacent the moveable closure;

a first gap disposed between the moveable closure and the horizontal surface;

a stationary vertical surface adjacent the moveable closure;

a second gap disposed between the moveable closure and the stationary vertical surface;

a first retaining member having a bottom surface;

a second retaining member having a bottom surface;

a first sealing member operably coupled to the first retaining member and extending across at least a portion of the first gap, at least a portion of the first sealing member being disposed proximate the bottom surface of the first retaining member;

a second sealing member operably coupled to the second retaining member, at least a portion of the second sealing member being disposed proximate the bottom surface of the second retaining member, the second sealing member not being directly attached to either the moveable closure or the stationary vertical surface; and a connecting member flexibly pivotably connecting the first retaining member to the second retaining member;

wherein the first retaining member is operably coupled to the moveable closure, and is positioned such that first sealing member overlies at least a portion of the first gap; and wherein the second retaining member overlies both at least a portion of the moveable closure and at least a portion of the stationary vertical surface, spanning the second gap.

8. A combination of an entryway of a structure and a sealing apparatus, comprising:

a moveable closure;

a horizontal surface adjacent the moveable closure;

a first gap disposed between the moveable closure and the horizontal surface;

a stationary vertical surface adjacent the moveable closure;

a second gap disposed between the moveable closure and the stationary vertical surface;

a first retaining member having a bottom surface;

a second retaining member having a bottom surface;

a first sealing member operably coupled to the first retaining member and extending across at least a portion of the first gap, at least a portion of the first sealing member being disposed proximate the bottom surface of the first retaining member;

a second sealing member operably coupled to the second retaining member, at least a portion of the second sealing member being disposed proximate the bottom surface of the second retaining member, the second sealing member not being directly attached to either the moveable closure or the stationary vertical surface; and a connecting member flexibly connecting the first retaining member to the second retaining member;

wherein the first retaining member is operably coupled to the moveable closure, and is positioned such that first sealing member overlies at least a portion of the first gap;

wherein the second retaining member overlies both at least a portion of the moveable closure and at least a portion of the stationary vertical surface, spanning the second gap; and wherein the connecting member biases the second retaining member towards the stationary vertical surface.

9. The combination of an entryway of a structure and a sealing apparatus according to claim 7, wherein the moveable closure comprises a breakout panel of a sliding door system.

10. The combination of an entryway of a structure and a sealing apparatus according to claim 7, wherein the stationary vertical surface comprises at least one of a door casing and a door frame.

11. A method of sealing an entryway having a moveable closure, a horizontal surface adjacent the moveable closure, a first gap disposed between the moveable closure and the horizontal surface, a stationary vertical surface adjacent the moveable closure, and a second gap disposed between the moveable closure and the stationary vertical surface, the method comprising the steps of:

providing a sealing apparatus comprising a first retaining member having a bottom surface, a second retaining member having a bottom surface, a first sealing member operably coupled to the first retaining member with at least a portion of the first sealing member being disposed proximate the bottom surface of the first retaining member, a second sealing member operably coupled to the second retaining member with at least a portion of the second sealing member being disposed proximate the bottom surface of the second retaining member, and a connecting member pivotably connecting the first retaining member to the second retaining member; and affixing the first retaining member to at least a portion of the moveable closure, such that the first sealing member overlies at least a portion of the first gap, and the second retaining member overlies both at least a portion of the moveable closure and at least a portion of the stationary vertical surface, spanning the second gap.

12. A method of sealing an entryway having a moveable closure, a horizontal surface adjacent the moveable closure, a first gap disposed between the moveable closure and the horizontal surface, a stationary vertical surface adjacent the moveable closure, and a second gap disposed between the moveable closure and the stationary vertical surface, the method comprising the steps of:

providing a sealing apparatus comprising a first retaining member having a bottom surface, a second retaining member having a bottom surface, a first sealing member operably coupled to the first retaining member with at least a portion of the first sealing member being disposed proximate the bottom surface of the first retaining member, a second sealing member operably coupled to the second retaining member with at least a portion of the second sealing member being disposed proximate the bottom surface of the second retaining member, and a connecting member flexibly connecting the first retaining member to the second retaining member; and affixing the first retaining member to at least a portion of the moveable closure, such that the first sealing member overlies at least a portion of the first gap, and the second retaining member overlies both at least a portion of the moveable closure and at least a portion of the stationary vertical surface, spanning the second gap;

wherein the connecting member biases the second retaining member towards the stationary vertical surface.

13. The method according to claim 11, wherein the moveable closure comprises a breakout panel of a sliding door system.

14. The method according to claim 11, wherein the stationary vertical surface comprises at least one of a door casing and a door frame.

15. The combination of an entryway of a structure and a sealing apparatus according to claim 7, wherein the connecting member does not fixedly connect the moveable closure to the stationary vertical surface.

16. The method according to claim 11, wherein the connecting member does not fixedly connect the moveable closure to the stationary vertical surface.

17. The method according to claim 11, wherein the second sealing member is not directly attached to either the movable closure or the stationary vertical surface.

* * * * *